US007559609B2

(12) United States Patent
Tsai

(10) Patent No.: US 7,559,609 B2
(45) Date of Patent: Jul. 14, 2009

(54) MULTIFUNCTIONAL ARMREST ASSEMBLY FOR CHAIR

(76) Inventor: Po-Chuan Tsai, 144, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 449 days.

(21) Appl. No.: 11/504,814

(22) Filed: Aug. 15, 2006

(65) Prior Publication Data

US 2008/0073965 A1 Mar. 27, 2008

(51) Int. Cl.
*A47C 7/54* (2006.01)

(52) U.S. Cl. ..... 297/411.35; 297/411.36; 297/411.37

(58) Field of Classification Search ..... 297/411.35, 297/411.37, 411.38
See application file for complete search history.

(56) References Cited

U.S. PATENT DOCUMENTS 6,059,366 A * 5/2000 Hu ..... 297/411.35
6,502,904 B1 * 1/2003 Hansen ..... 297/411.35
6,948,775 B2 * 9/2005 Tsai ..... 297/411.37
7,150,504 B1 * 12/2006 Lee ..... 297/411.35
7,159,947 B1 * 1/2007 Lee ..... 297/411.37 X

* cited by examiner

*Primary Examiner*—Anthony D Barfield
(74) *Attorney, Agent, or Firm*—Alan Kamrath; Kamrath & Associates PA

(57) ABSTRACT

An armrest assembly for a chair includes an armrest support, a slide seat mounted on the armrest support, a first slide mounted on the slide seat, a second slide mounted on the first slide, a rotation member mounted on the second slide, a retainer mounted on the rotation member, a mounting member secured in the armrest support and provided with a stud extended through the first slide, the second slide and the rotation member and secured to the retainer, and an armrest mounted on the first slide. Thus, the armrest is movable in the axial direction and the transverse direction and is rotatable horizontally relative to the armrest support, so that the position of the armrest can be adjusted easily and freely according to the user's practical requirement.

18 Claims, 11 Drawing Sheets

MULTIFUNCTIONAL ARMREST ASSEMBLY FOR CHAIR

BACKGROUND OF THE INVENTION

1. Field of the Invention

The present invention relates to an armrest assembly and, more particularly, to a multifunctional armrest assembly for a chair.

2. Description of the Related Art

A conventional armrest assembly for a chair in accordance with the prior art shown in FIG. 11 comprises a track 31 mounted on the bottom of a seat 3 and having a bottom formed with an elongated guide slot 310, and two armrests 2 each having a bent lower end slidably mounted in the track 31 and releasably locked by a rotation knob 4 which is slidable in the guide slot 310 of the track 31 and screwed into the respective armrest 2. Thus, each of the armrests 2 is locked on the track 31 by screwing the respective rotation knob 4 and unlocked from and movable in the track 31 by unscrewing the respective rotation knob 4. Thus, each of the two armrests 2 is movable rightward and leftward relative to the seat 3 to adjust the distance between the armrests 2 so as to fit the user's requirement.

However, each of the two armrests 2 cannot be movable forward and backward relative to the seat 3 to adjust the axial position thereof and cannot be rotatable relative to the seat 3 to adjust the angle thereof, thereby limiting the versatility of the armrest assembly.

BRIEF SUMMARY OF THE INVENTION

In accordance with the present invention, there is provided an armrest assembly, comprising an armrest support, a slide seat mounted on the armrest support, a first slide mounted on the slide seat, a second slide mounted on the first slide, a rotation member mounted on the second slide, a retainer mounted on the rotation member, a mounting member secured in the armrest support and provided with a stud extended through the first slide, the second slide and the rotation member and secured to the retainer, and an armrest mounted on the first slide to encompass the retainer, the rotation member and the second slide.

The primary objective of the present invention is to provide a multifunctional armrest assembly for a chair.

Another objective of the present invention is to provide an armrest assembly, wherein the armrest is movable in the axial direction and the transverse direction and is rotatable horizontally relative to the armrest support, so that the position of the armrest can be adjusted easily and freely according to the user's practical requirement.

A further objective of the present invention is to provide an armrest assembly, wherein the roller units of the second slide and the roller units of the rotation member function to facilitate movement of the first slide and the second slide so as to facilitate movement of the armrest.

A further objective of the present invention is to provide an armrest assembly, wherein each of the guide flanges of the second slide is guided by the respective guide groove of the rotation member to facilitate movement of the second slide without incurring vibration.

A further objective of the present invention is to provide an armrest assembly, wherein the slide seat is rested on a bottom of the first slide to cover an exposed portion of the first slide during movement of the first slide, thereby enhancing the aesthetic quality of the armrest assembly.

A further objective of the present invention is to provide an armrest assembly, wherein the user only needs to move the armrest to adjust the position of the armrest, so that the user can adjust the position of the armrest in an energy-saving way.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
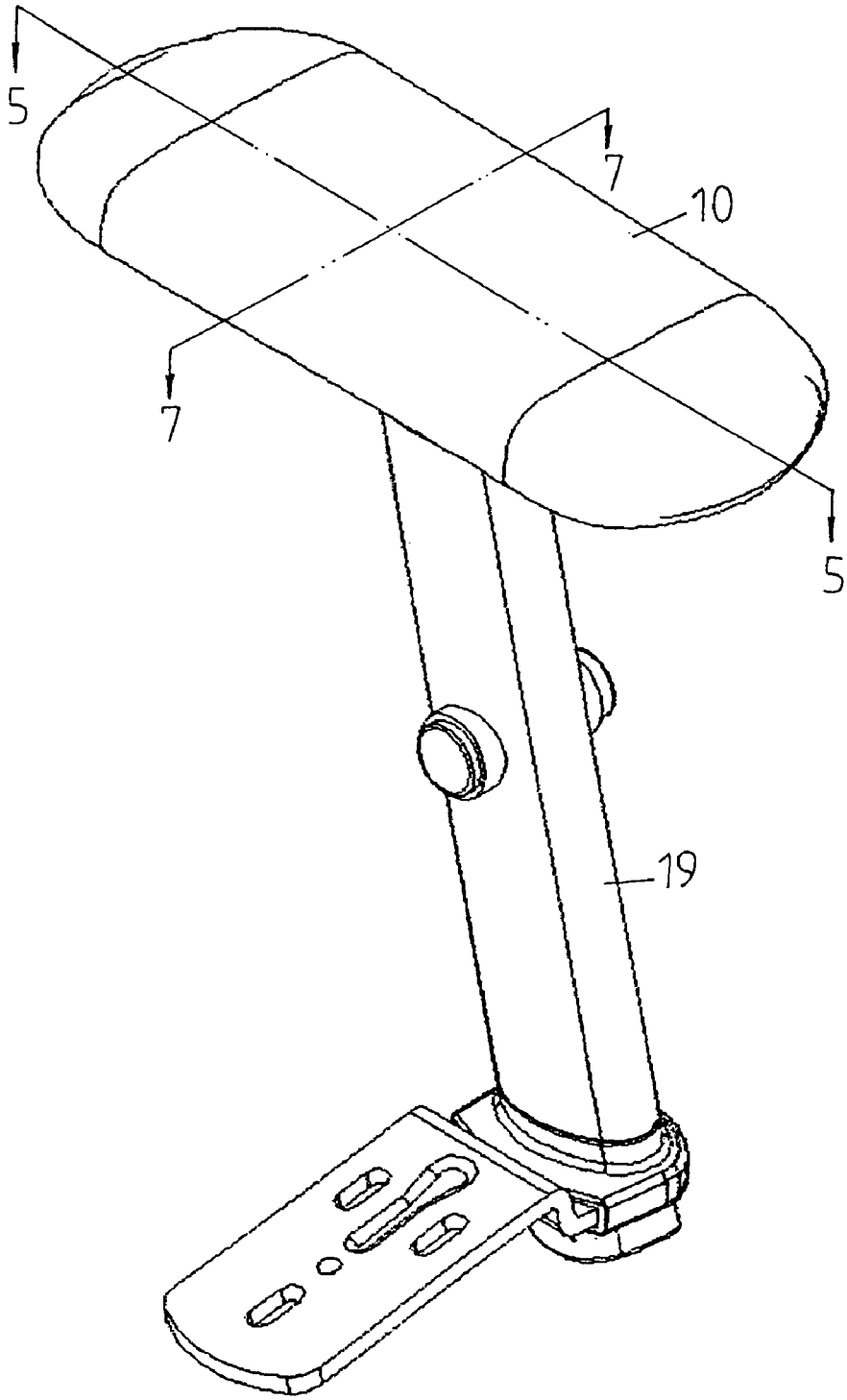
FIG. 1 is a perspective view of an armrest assembly in accordance with the preferred embodiment of the present invention.
Figure 2:
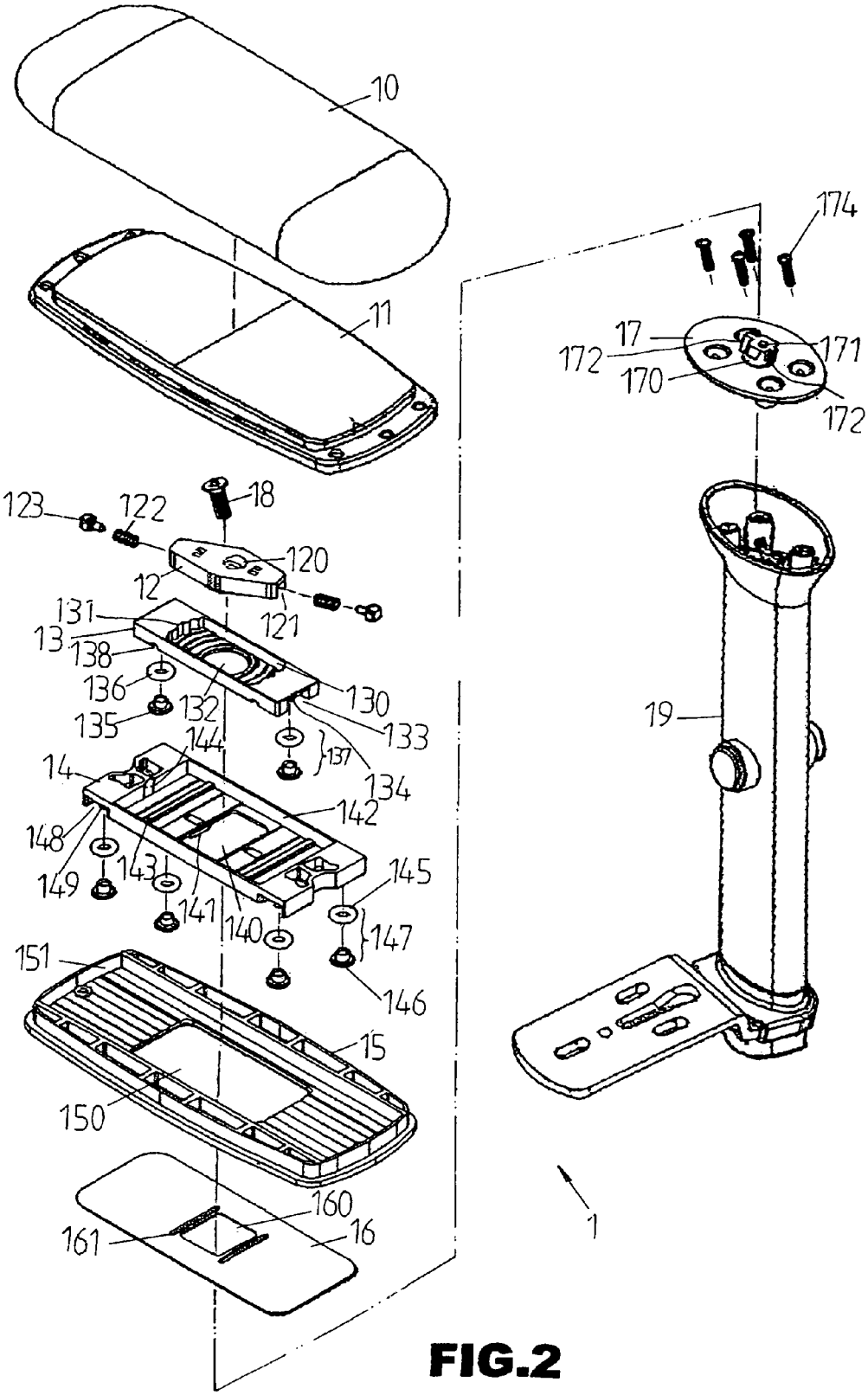
FIG. 2 is an exploded perspective view of the armrest assembly as shown in FIG. 1.
Figure 3:
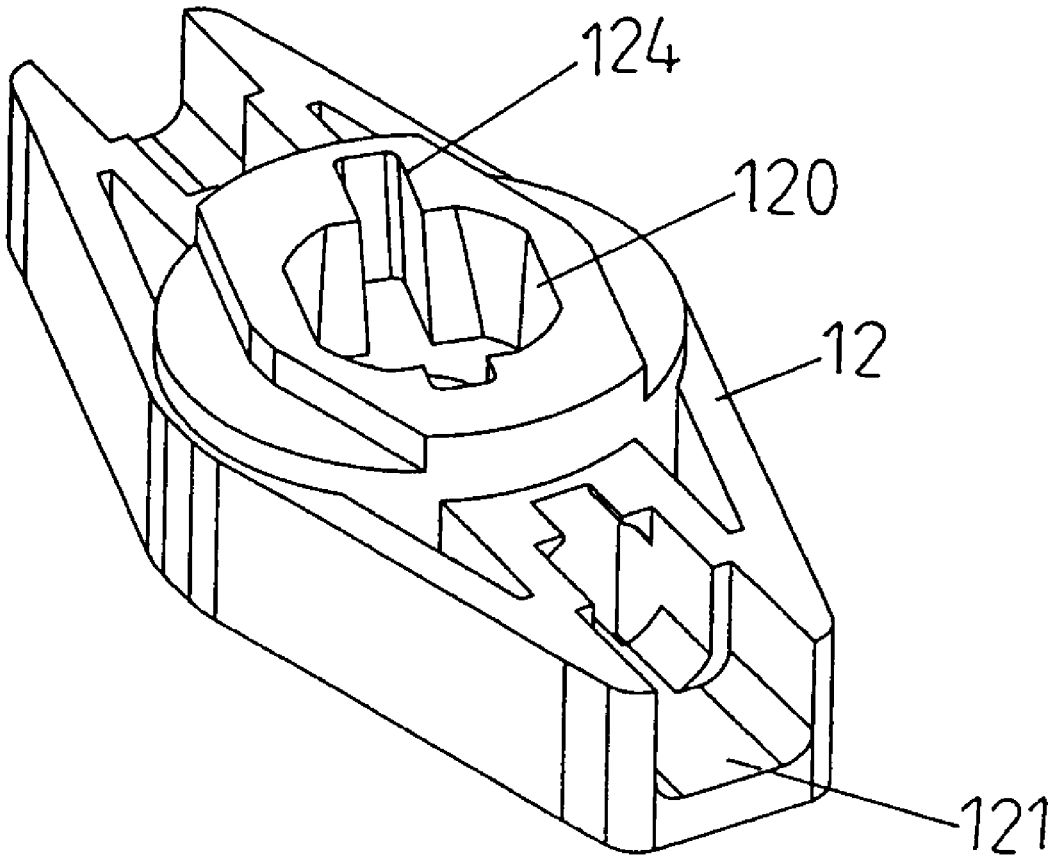
FIG. 3 is a perspective enlarged view of a retainer of the armrest assembly as shown in FIG. 2.

Referring to the drawings and initially to FIGS. 1-7, an armrest assembly 1 in accordance with the preferred embodiment of the present invention comprises an armrest support 19, a slide seat 16 mounted on the armrest support 19, a first slide 15 mounted on the slide seat 16, a second slide 14 mounted on the first slide 15, a rotation member 13 mounted on the second slide 14, a retainer 12 mounted on the rotation member 13, a mounting member 17 secured in the armrest support 19 by bolts 174 and provided with a stud 170 extended through the first slide 15, the second slide 14 and the rotation member 13 and secured to the retainer 12, an armrest 10 mounted on the first slide 15 to encompass the retainer 12, the rotation member 13 and the second slide 14, and a reinforcement 11 mounted between the armrest 10 and the first slide 15.

Thus, the first slide 15 is movable relative to the slide seat 16 in an axial direction so that the armrest 10 is movable relative to the armrest support 19 in the axial direction, the first slide 15 and the second slide 14 are movable relative to the slide seat 16 in a transverse direction so that the armrest 10 is movable relative to the armrest support 19 in the transverse direction, and the slide seat 16, the first slide 15, the second slide 14 and the rotation member 13 are rotatable relative to the retainer 12 and the mounting member 17 so that the armrest 10 is rotatable relative to the armrest support 19.

The slide seat 16 has a passage 160 to allow passage of the stud 170 of the mounting member 17 and has two transverse guide slots 161.

The first slide 15 has a passage 150 to allow passage of the stud 170 of the mounting member 17 and a top space 151 in which the second slide 14 is movable in the axial direction.

The second slide 14 has a passage 140 to allow passage of the stud 170 of the mounting member 17 and a top chamber 142 in which the rotation member 13 is movable in the transverse direction. The top chamber 142 of the second slide 14 has two transverse guide flanges 143 and two arcuate positioning grooves 144. The second slide 14 has a bottom provided with two transverse guide rails 141 each slidable in the respective guide slot 161 of the slide seat 16 and a plurality of recesses 148 each provided with a post 149 for mounting a roller unit 147 rotatably mounted in the top space 151 of the first slide 15 and including a roller 146 and an O-ring 145.

Figure 4:
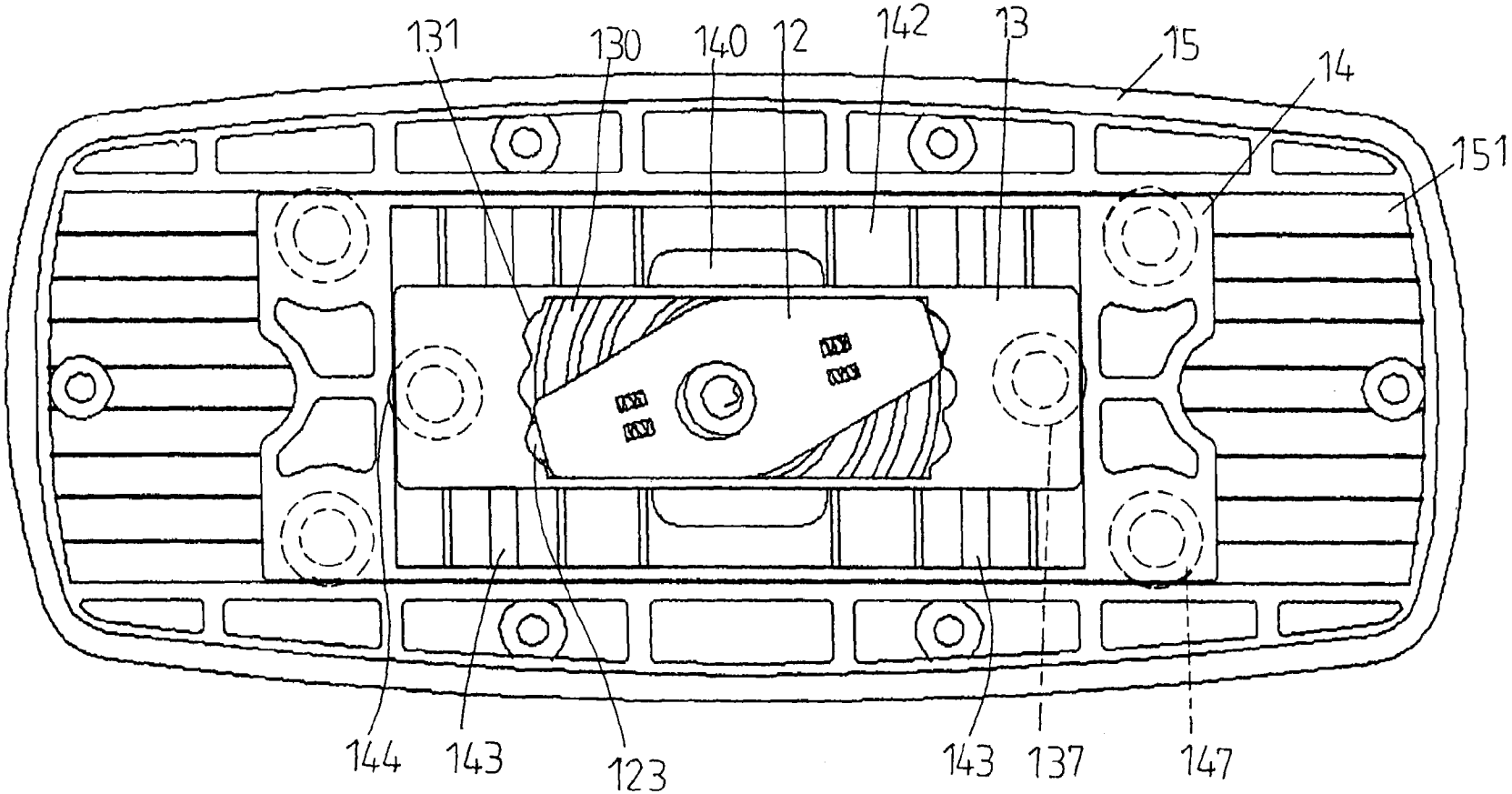
FIG. 4 is a top plan broken view of the armrest assembly as shown in FIG. 1.
Figure 5:
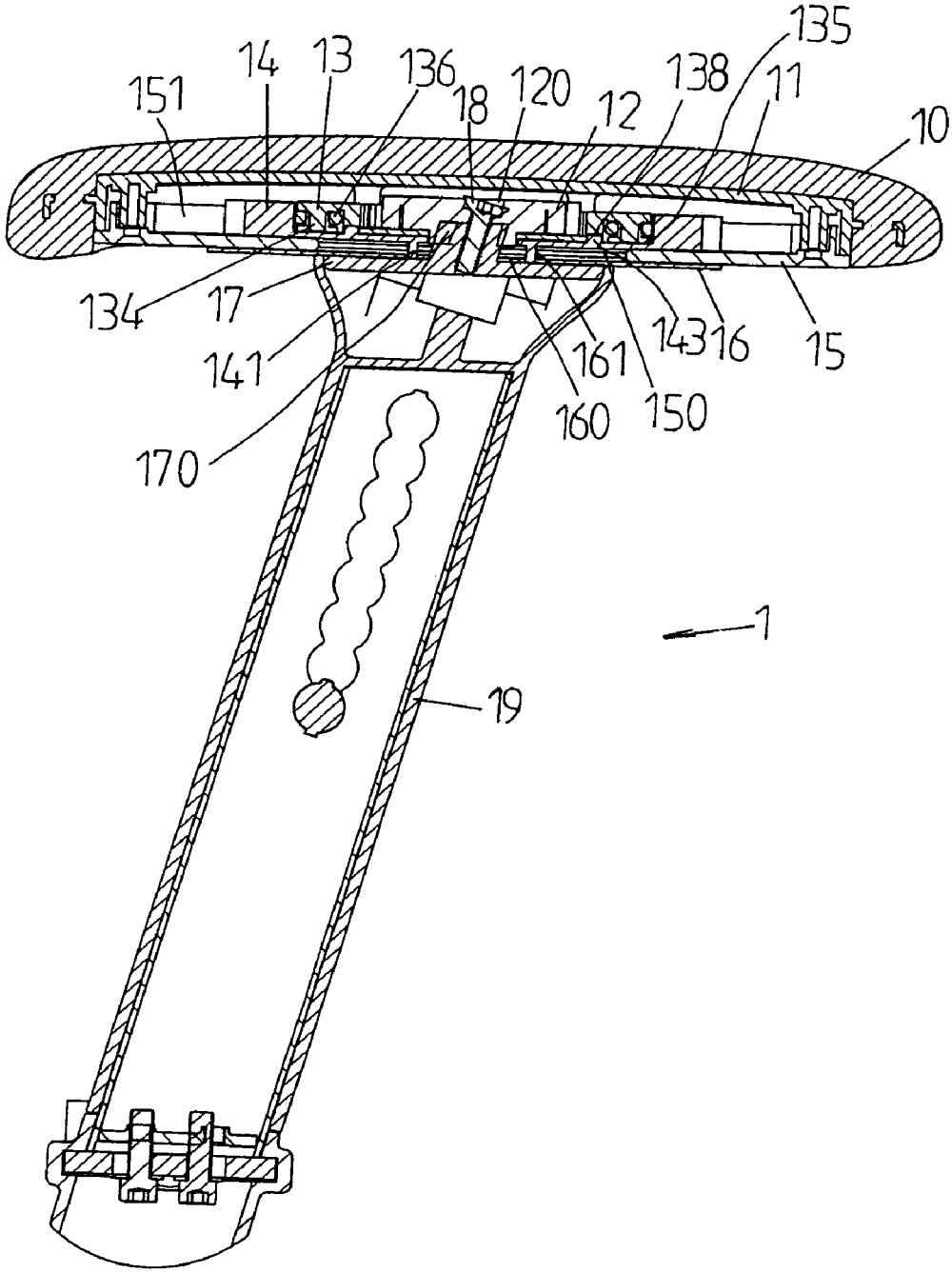
FIG. 5 is a plan cross-sectional view of the armrest assembly taken along line 5-5 as shown in FIG. 1.
Figure 6:
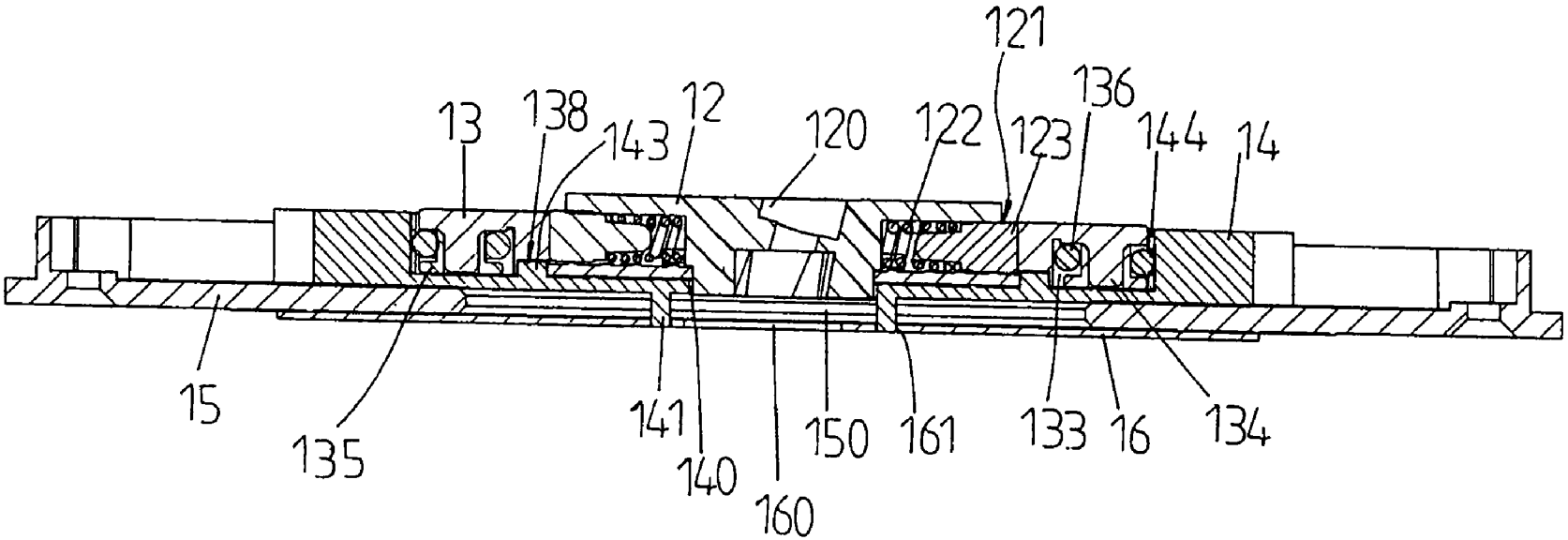
FIG. 6 is a locally enlarged view of the armrest assembly as shown in FIG. 5.
Figure 7:
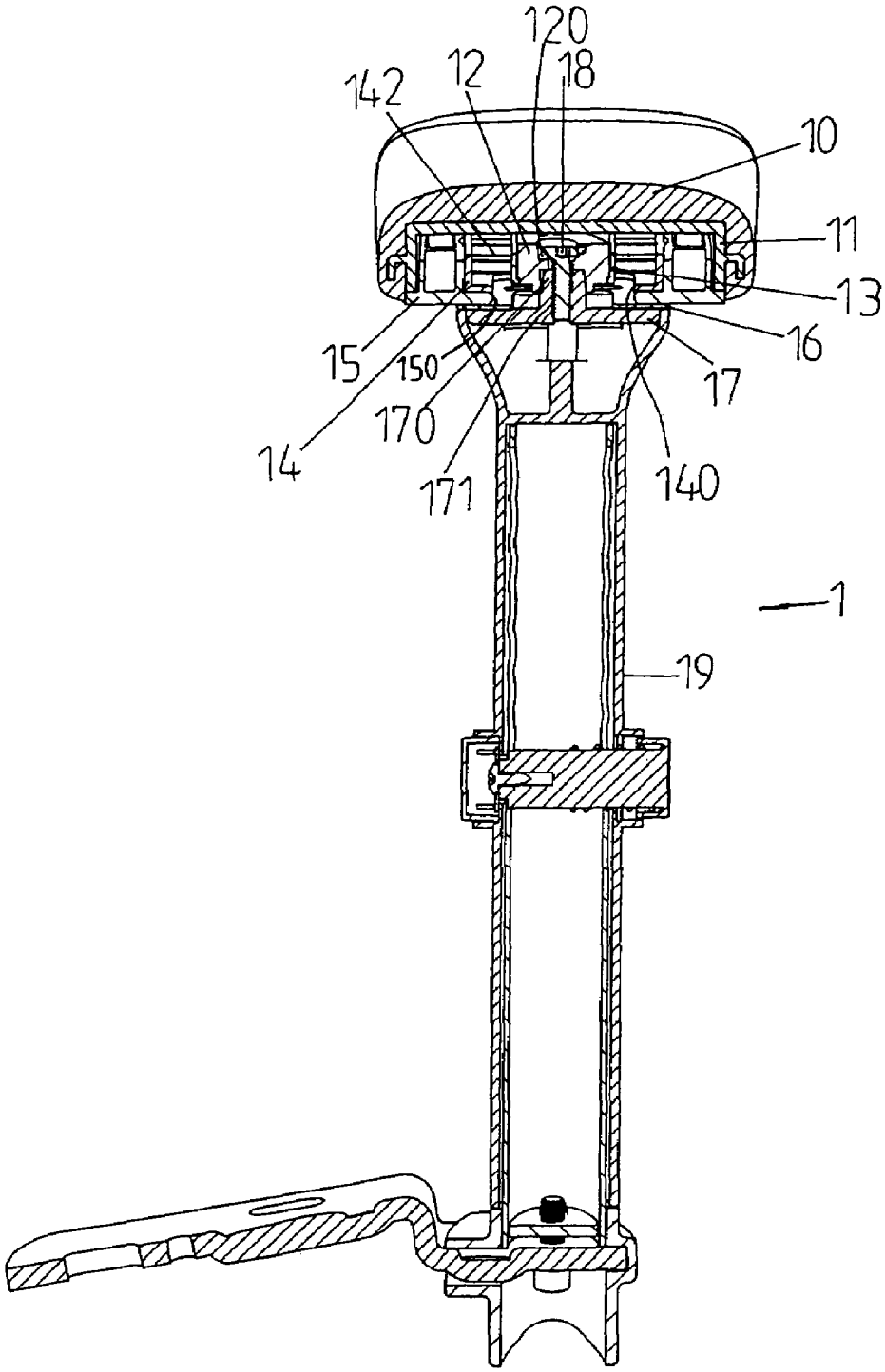
FIG. 7 is a plan cross-sectional view of the armrest assembly taken along line 7-7 as shown in FIG. 1.

The rotation member 13 has a passage 132 to allow passage of the stud 170 of the mounting member 17 and a top compartment 130 in which the retainer 12 is rotatable in an inclined manner as shown in FIG. 4. The top compartment 130 of the rotation member 13 has two arcuate toothed portions 131. The rotation member 13 has a bottom provided with two transverse guide grooves 138 each slidable on the respective guide flange 143 of the second slide 14 and two openings 133 each provided with a post 134 for mounting a roller unit 137 mounted in the respective positioning groove 144 of the second slide 14 and including a roller 135 and an O-ring 136.

The retainer 12 has a mounting hole 120 to allow passage of the stud 170 of the mounting member 17 and two breaches 121 for mounting a spring 122 and a locking stub 123 engaged with the respective toothed portion 131 of the rotation member 13. The mounting hole 120 of the retainer 12 has two chutes 124.

The stud 170 of the mounting member 17 has two ramps 172 each mounted in the respective chute 124 of the retainer 12 and has a screw bore 171. A screw 18 is screwed into the screw bore 171 of the stud 170 of the mounting member 17 and rested on the retainer 12 to secure the retainer 12 to the mounting member 17.

Figure 8:
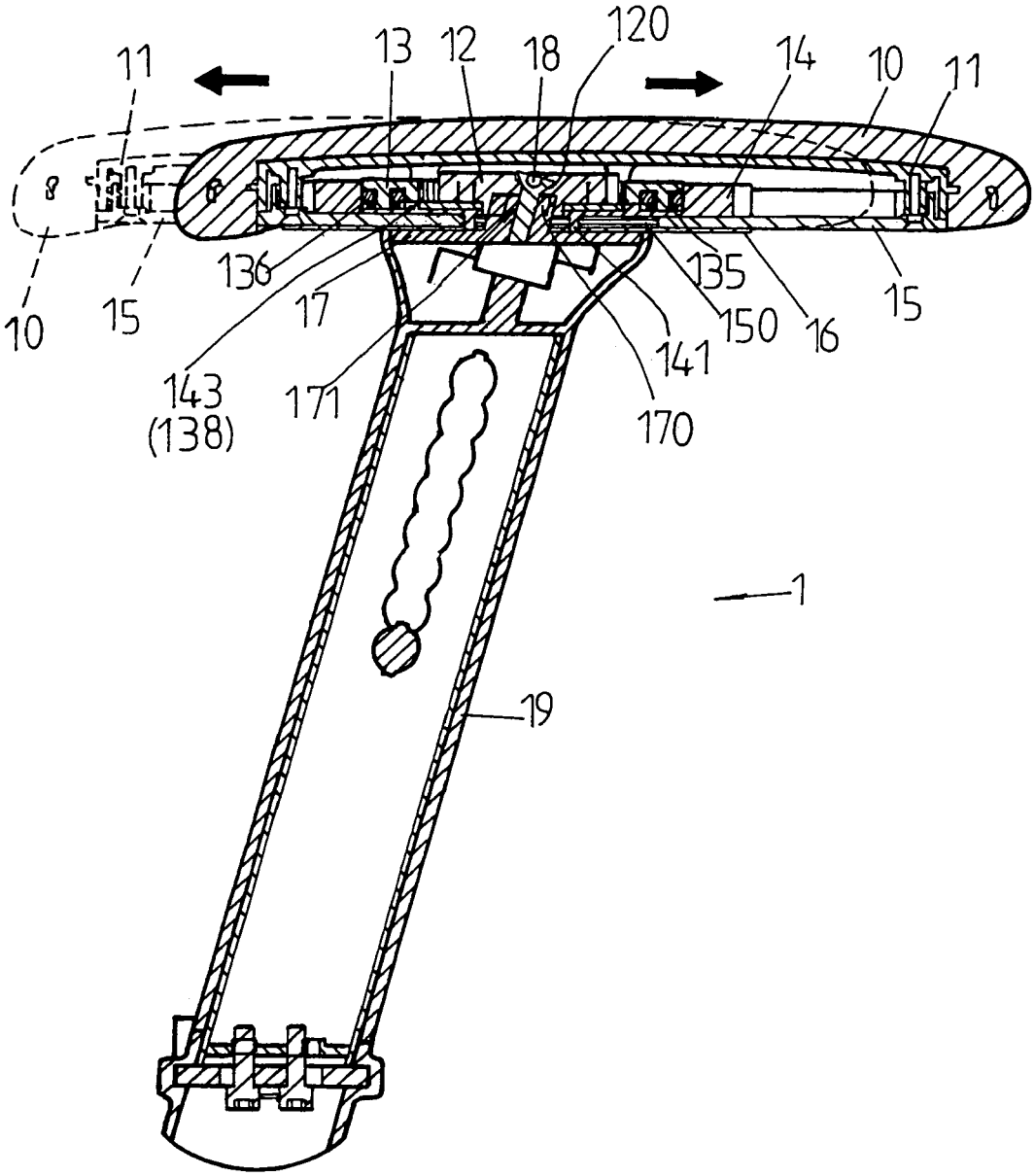
FIG. 8 is a schematic operational view of the armrest assembly as shown in FIG. 5.

As shown in FIG. 8, when the armrest 10 is movable forward and downward relative to the armrest support 19 in the axial direction, the first slide 15 is driven by the armrest 10 and movable relative to the slide seat 16 in the axial direction, while the retainer 12, the rotation member 13, the second slide 14 and the slide seat 16 are fixed during the axial movement of the first slide 15. At this time, each of the roller units 147 of the second slide 14 is rested on a side of the top space 151 of the first slide 15 during the axial movement of the first slide 15, so that the first slide 15 is movable in the axial direction in a stepless way, and the armrest 10 is movable in the axial direction in a stepless way.

Figure 9:
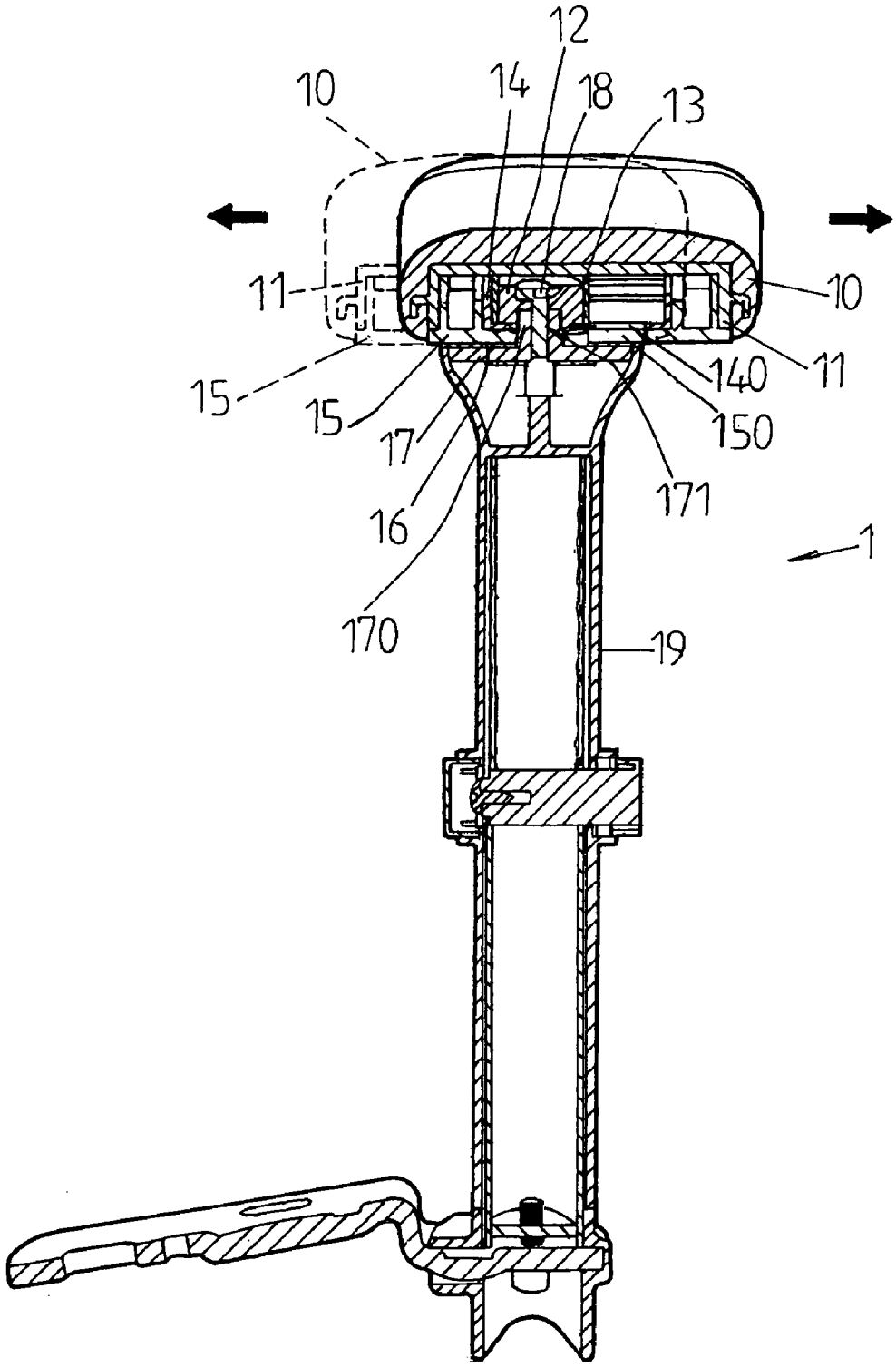
FIG. 9 is a schematic operational view of the armrest assembly as shown in FIG. 7.

As shown in FIG. 9, when the armrest 10 is movable rightward and leftward relative to the armrest support 19 in the transverse direction, the first slide 15 and the second slide 14 are driven by the armrest 10 and movable relative to the slide seat 16 in the transverse direction, while the retainer 12, the rotation member 13 and the slide seat 16 are fixed during the transverse movement of the first slide 15 and the second slide 14. At this time, each of the roller units 137 of the rotation member 13 is rested on a side of the top chamber 142 of the second slide 14 during the transverse movement of the first slide 15 and the second slide 14 to facilitate movement of the armrest 10. At the same time, each of the guide flanges 143 of the second slide 14 is guided by the respective guide groove 138 of the rotation member 13 and each of the guide rails 141 of the second slide 14 is guided by the respective guide slot 161 of the slide seat 16 during the transverse movement of the first slide 15 and the second slide 14.

Figure 10:
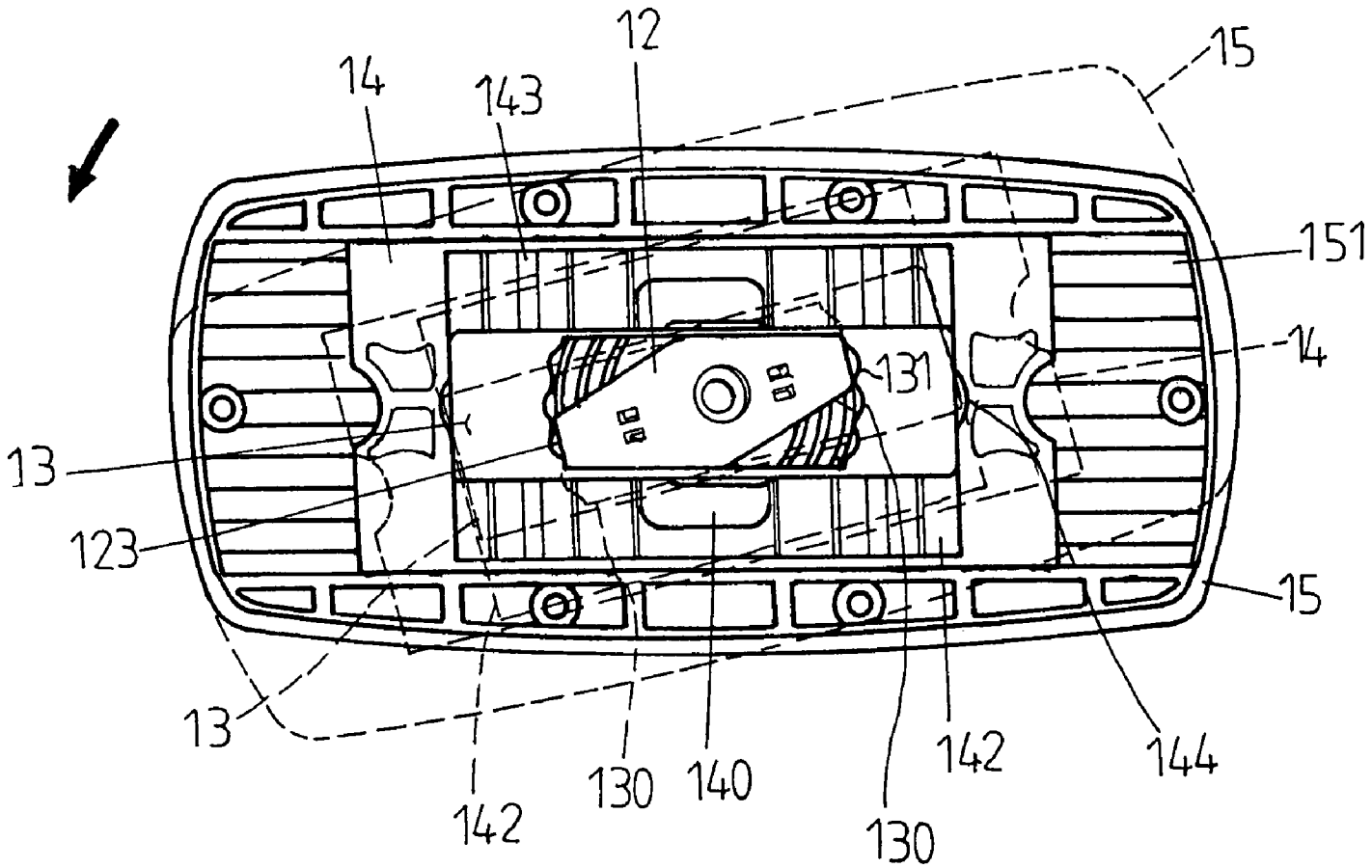
FIG. 10 is a schematic operational view of the armrest assembly as shown in FIG. 4.
Figure 11:
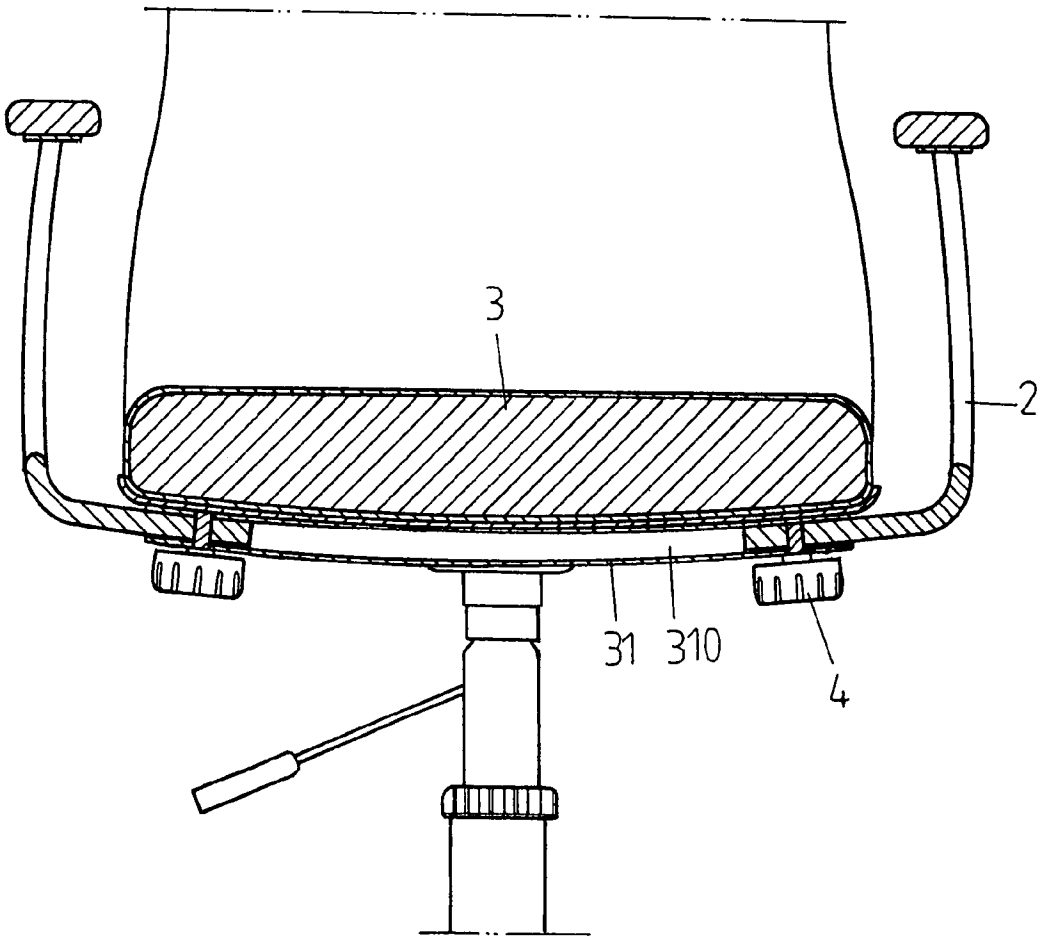
FIG.11 (PRIOR ART)
FIG. 11 is a plan cross-sectional view of a conventional armrest assembly in accordance with the prior art.

As shown in FIG. 10, when the armrest 10 is rotatable relative to the armrest support 19, the slide seat 16, the first slide 15, the second slide 14 and the rotation member 13 are rotatable relative to the retainer 12 and the mounting member 17. At the same time, the locking stub 123 of the retainer 12 is engaged with the respective toothed portion 131 of the rotation member 13 during rotation of the rotation member 13 relative to the retainer 12, so that the rotation member 13 is rotatable in a stepless way, and the armrest 10 is rotatable in a stepless way.

Accordingly, the armrest 10 is movable in the axial direction and the transverse direction and is rotatable horizontally relative to the armrest support 19 to adjust its angle, so that the position of the armrest 10 can be adjusted easily and freely according to the user's practical requirement. In addition, the roller units 147 of the second slide 14 and the roller units 137 of the rotation member 13 function to facilitate movement of the first slide 15 and the second slide 14 so as to facilitate movement of the armrest 10. Further, each of the guide flanges 143 of the second slide 14 is guided by the respective guide groove 138 of the rotation member 13 to facilitate movement of the second slide 14 without incurring vibration. Further, the slide seat 16 is rested on a bottom of the first slide 15 to cover an exposed portion of the first slide 15 during movement of the first slide 15, thereby enhancing the aesthetic quality of the armrest assembly. Further, the user only needs to move the armrest 10 to adjust the position of the armrest 10, so that the user can adjust the position of the armrest 10 in an energy-saving way.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest assembly, comprising:

an armrest support;

a slide seat mounted on the arrest support;

a first slide mounted on the slide seat;

a second slide mounted on the first slide;

a rotation member mounted on the second slide;

a retainer mounted on the rotation member;

a mounting member secured in the armrest support and provided with a stud extended through the first slide, the second slide and the rotation member and secured to the retainer;

an armrest mounted on the first slide to encompass the retainer, the rotation member and the second slide;

wherein the slide seat has two transverse guide slots;

the second slide has a bottom provided with two transverse guide rails each slidable in the respective guide slot of the slide seat.

2. The armrest assembly in accordance with claim 1, wherein the first slide has a top space in which the second slide is movable in an axial direction.

3. The armrest assembly in accordance with claim 2, wherein the second slide has a bottom provided with a plurality of recesses each provided with a post for mounting a roller unit rotatably mounted in the top space of the first slide.

4. The armrest assembly in accordance with claim 3, wherein the roller unit includes a roller and an O-ring.

5. The armrest assembly in accordance with claim 1, wherein the second slide has a top chamber in which the rotation member is movable in a transverse direction.

6. The armrest assembly in accordance with claim 5, wherein the top chamber of the second slide has two transverse guide flanges, and the rotation member has a bottom provided with two transverse guide grooves each slidable on the respective guide flange of the second slide.

7. The armrest assembly in accordance with claim 5, wherein the top chamber of the second slide has two arcuate positioning grooves, and the rotation member has a bottom provided with two openings each provided with a post for mounting a roller unit mounted in the respective positioning groove of the second slide.

8. The armrest assembly in accordance with claim 7, wherein the roller unit includes a roller and an O-ring.

9. The armrest assembly in accordance with claim 1, wherein the rotation member has a top compartment in which the retainer is rotatable in an inclined manner.

10. The armrest assembly in accordance with claim 9, wherein the top compartment of the rotation member has two arcuate toothed portions, and the retainer has two breaches for mounting a spring and a locking stub engaged with the respective toothed portion of the rotation member.

11. The armrest assembly in accordance with claim 1, wherein the stud of the mounting member has a screw bore, and the armrest assembly further comprises a screw screwed into the screw bore of the stud of the mounting member and rested on the retainer to secure the retainer to the mounting member.

12. The armrest assembly in accordance with claim 1, wherein the first slide is movable relative to the slide seat in an axial direction so that the armrest is movable relative to the armrest support in the axial direction, the first slide and the second slide are movable relative to the slide seat in a transverse direction so that the armrest is movable relative to the armrest support in the transverse direction, and the slide seat, the first slide, the second slide and the rotation member are rotatable relative to the retainer and the mounting member so that the armrest is rotatable relative to the armrest support.

13. The armrest assembly in accordance with claim 12, wherein when the armrest is movable relative to the armrest support in the axial direction, the first slide is driven by the armrest and movable relative to the slide seat in the axial direction, while the retainer, the rotation member, the second slide and the slide seat are fixed during the axial movement of the first slide.

14. The armrest assembly in accordance with claim 1, wherein when the armrest is movable relative to the armrest support in the transverse direction, the first slide and the second slide arc driven by the armrest and movable relative to the slide seat in the transverse direction, while the retainer, the rotation member and the slide seat are fixed during the transverse movement of the first slide and the second slide.

15. The armrest assembly in accordance with claim 1, further comprising a reinforcement mounted between the armrest and the first slide.

16. The armrest assembly in accordance with claim 1, wherein the slide seat has a passage to allow passage of the stud of the mounting member, the first slide has a passage to allow passage of the stud of the mounting member, the second slide has a passage to allow passage of the stud of the mounting member, and the rotation member has a passage to allow passage of the stud of the mounting member.

17. The armrest assembly in accordance with claim 1, wherein the slide seat is rested on a bottom of the first slide to cover an exposed portion of the first slide during movement of the first slide.

18. An armrest assembly, comprising:

an armrest support;

a slide seat mounted on the armrest support;

a first slide mounted on the slide seat;

a second slide mounted on the first slide;

a rotation member mounted on the second slide;

a retainer mounted on the rotation member;

a mounting member secured in the armrest support and provided with a stud extended through the first slide, the second slide and the rotation member and secured to the retainer;

an armrest mounted on the first slide to encompass the retainer, the rotation member and the second slide;

wherein the retainer has a mounting hole to allow passage of the stud of the mounting member;

the mounting hole of the retainer has two chutes;

the stud of the mounting member has two ramps each mounted in the respective chute of the retainer.

* * * * *